US007271532B2

(12) United States Patent
Dean et al.

(10) Patent No.: US 7,271,532 B2
(45) Date of Patent: Sep. 18, 2007

(54) FIELD EMISSION DISPLAY

(75) Inventors: Kenneth A. Dean, Phoenix, AZ (US); Bernard F. Coll, Fountain Hills, AZ (US); Emmett M. Howard, Gilbert, AZ (US)

(73) Assignee: Motorola, Inc., Schaumburg, IL (US)

( * ) Notice: Subject to any disclaimer, the term of this patent is extended or adjusted under 35 U.S.C. 154(b) by 327 days.

(21) Appl. No.: 11/082,715

(22) Filed: Mar. 16, 2005

(65) Prior Publication Data

US 2006/0208625 A1 Sep. 21, 2006

(51) Int. Cl.
*H01J 1/62* (2006.01)

(52) U.S. Cl. ..... 313/495; 313/309; 313/310

(58) Field of Classification Search ..... 313/495, 313/496, 309, 310, 336, 351
See application file for complete search history.

(56) References Cited

U.S. PATENT DOCUMENTS 6,072,272 A 6/2000 Rumbaugh

OTHER PUBLICATIONS

J. Dijon et al., "Towards a Low-Cost High Quality Carbon-Nanotube Field-Emission Display," Journal of the Society of Information Display 12, 373 (2004).

B. Coll et al. "Nano-Emitters for Big FEDs: The Carbon Nanotube Solution," Proceedings of the 22nd International Display Research Conference (Eurodisplay 2002), 219 (2002).

K.A. Dean, "Low Cost Nanotube Field Emission Displays for Large Area Applications," Proceedings of the 8th Asian Symposium of Information Display (ASID '04), 216 (2004).

*Primary Examiner*—Vip Patel

(57) ABSTRACT

An apparatus is provided for reducing color bleed in a flat panel display. The apparatus comprises an anode (30) with a plurality of phosphors (28) of at least two colors sequentially disposed thereon. A cathode (14) is arranged in parallel opposed position to and separated from the anode (30) and contains a plurality of pads (40) of emitters. Each pad (40) is disposed on the cathode (14) in spaced relationship to and aligned with one of the at least two colors, respectively, wherein electrons from each of the plurality of pads of emitters that drift from its intended phosphor (28) are encouraged to drift toward an adjacent phosphor (28) of the same color.

20 Claims, 4 Drawing Sheets

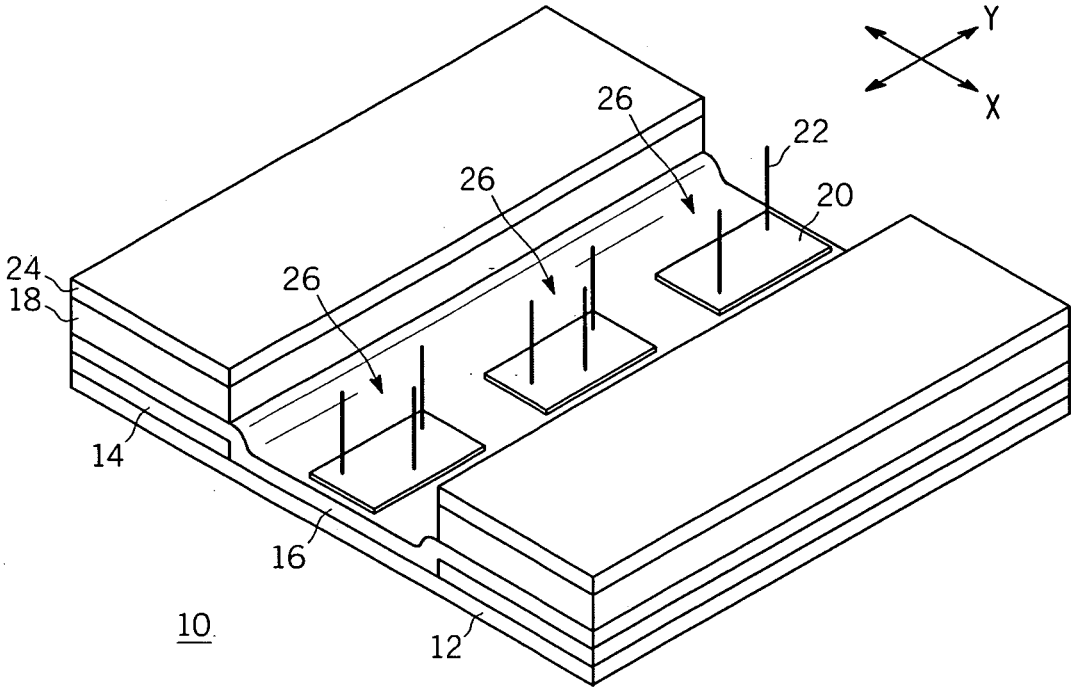
FIG. 1
-PRIOR ART-
FIG. 2
-PRIOR ART-
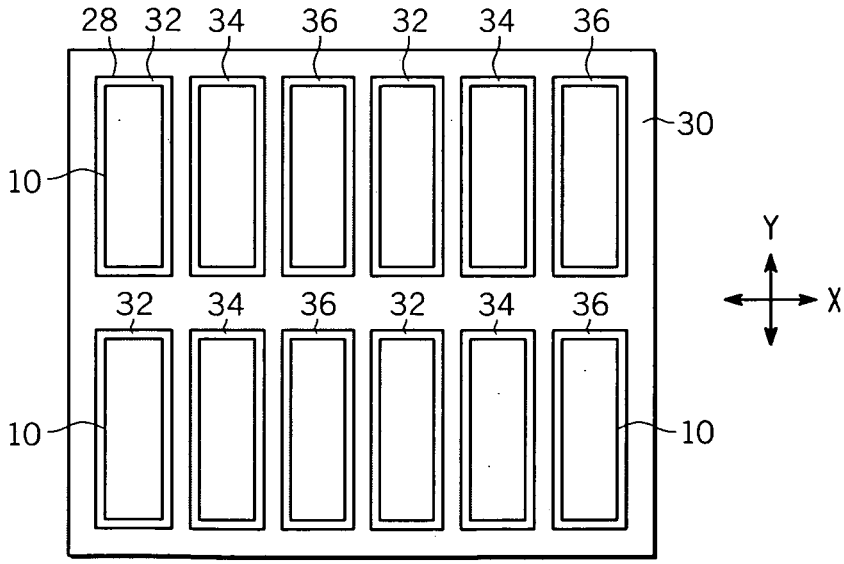

-PRIOR ART-

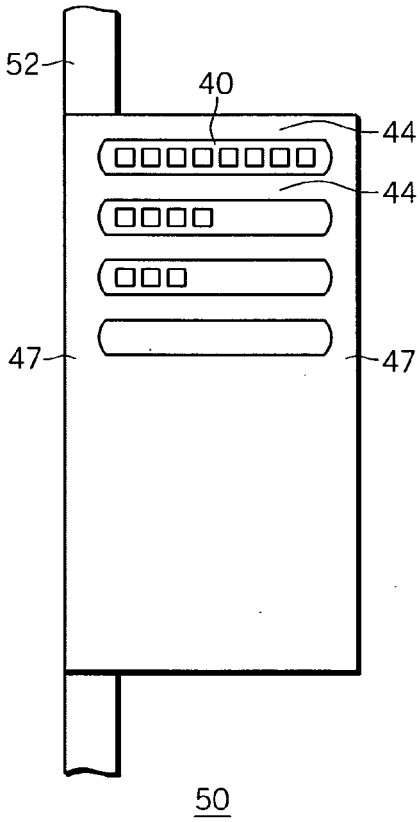
FIG. 5
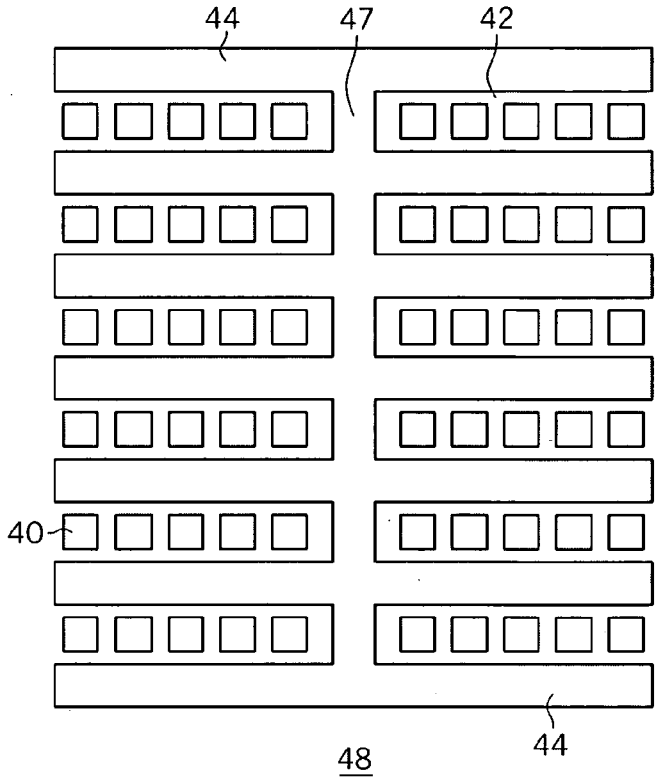
FIG. 6
FIG. 7
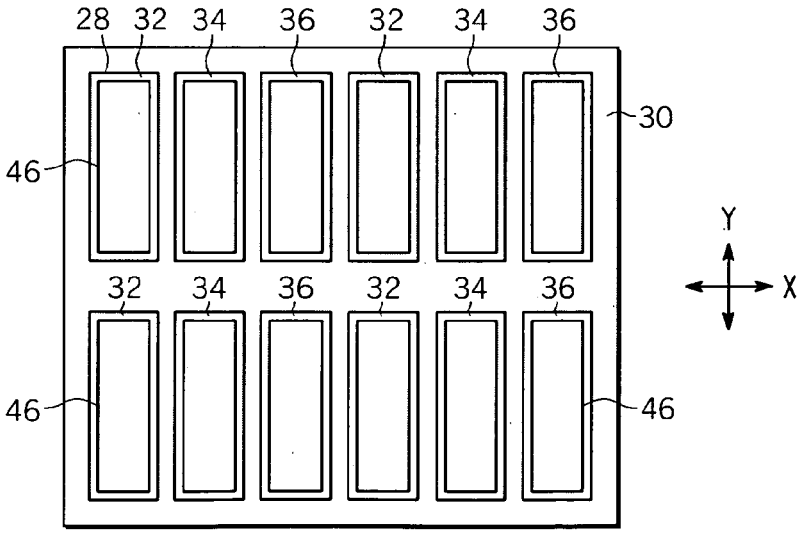

FIELD EMISSION DISPLAY

FIELD OF THE INVENTION

The present invention generally relates to a flat panel display and more particularly to a cold cathode display.

BACKGROUND OF THE INVENTION

Field emission displays include an anode and a cathode structure. The cathode is configured into a matrix of rows and columns, such that a given pixel can be individually addressed. Addressing is accomplished by placing a positive voltage on one row at a time. During the row activation time, data is sent in parallel to each pixel in the selected row by way of a negative voltage applied to the column connections, while the anode is held at a high positive voltage. The voltage differential between the addressed cathode pixels and the anode accelerates the emitted electrons toward the anode.

Color field emission display devices typically include a cathodoluminescent material underlying an electrically conductive anode. The anode resides on an optically transparent frontplate and is positioned in parallel relationship to an electrically conductive cathode. The cathode is typically attached to a glass backplate and a two dimensional array of field emission sites is disposed on the cathode. The anode is divided into a plurality of pixels and each pixel is divided into three subpixels. Each subpixel is formed by a phosphor corresponding to a different one of the three primary colors, for example, red, green, and blue. Correspondingly, the electron emission sites on the cathode are grouped into pixels and subpixels, where each emitter subpixel is aligned with a red, green, or blue subpixel on the anode. By individually activating each subpixel, the resulting color can be varied anywhere within the color gamut triangle. The color gamut triangle is a standardized triangular-shaped chart used in the color display industry. The color gamut triangle is defined by each individual phosphor's color coordinates, and shows the color obtained by activating each primary color to a given output intensity.

So long as the pixels are sufficiently large, relative to a given electron beam size, the color gamut available at the frontplate of the display is only limited by color output of a given phosphor. Under ideal operating conditions, electrons emitted by the addressed emitter subpixels on the cathode only strike the intended subpixel on the anode. However, in many practical systems of interest, such as high-voltage displays, the beam width of the emitted electons is not confined to a particular subpixel on the anode. At the relatively large cathode to anode separation distances used in high voltage displays, the electron beam spreads and stray electrons can strike adjacent subpixels on the anode. This phenomenon is known as "color bleed". As the color bleed increases, the available color gamut of the display is decreased. The color purity is reduced and the image resolution and sharpness is reduced.

To overcome the loss of color gamut, switched anode techniques in combination with frame sequential addressing have been developed. A switched anode provides separate circuits for subpixels of the same color, but located in adjacent pixels. The groups of subpixels on the anode are electrically connected to form two separate networks. An electronic control system is provided for sequentially addressing alternating rows and columns of pixels on the anode and on the cathode. Adjacent pixels are assigned an odd or even designation in order to separate the activation of the same color subpixels located in adjacent pixels on the anode.

Another method used to overcome color bleed is to add additional electrodes in the cathode to focus the emitted electron beam. The electron beam spreading is controlled by electrostatically confining the electron beam, such that the beam strikes the intended subpixel on the anode.

While the switched anode techniques and additional focusing structures improve color performance, these can be difficult to implement in a high voltage display and they require more complicated electronics, which add to the expense of the display. Furthermore, additional processing steps are often necessary, which increase the manufacturing cost of the display. Accordingly, a need exists for a low-cost, color field emission display having improved color performance.

Accordingly, it is desirable to provide a cathode design that substantially reduces color bleed. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

An apparatus is provided for reducing color bleed in a flat panel display. The apparatus comprises an anode with a plurality of phosphors of at least two colors sequentially disposed thereon. A cathode is arranged in parallel opposed position to and separated from the anode and contains a plurality of pads of emitters. Each pad is disposed on the cathode in spaced relationship to and aligned with one of the at least two colors, respectively, wherein electrons from each of the plurality of pads of emitters that drift from its intended phosphor are encouraged to drift toward an adjacent phosphor of the same color.

BRIEF DESCRIPTION OF THE DRAWINGS

The present invention will hereinafter be described in conjunction with the following drawing figures, wherein like numerals denote like elements, and FIG. 1 is a partial isometric schematic view of a known carbon nanotube display device;

FIG. 2 is a partial schematic bottom view of an anode and cathode of the device of FIG. 1;

FIG. 5 is a partial schematic view of an array of red, green, and blue subpixels in accordance with an embodiment of the present invention;

FIG. 6 is a comparison of beam profiles of the devices of FIGS. 4 and 5;

FIG. 7 is a beam profile of the device of FIG. 4 versus red, green, and blue frequencies;

DETAILED DESCRIPTION OF THE INVENTION

Figure 3:
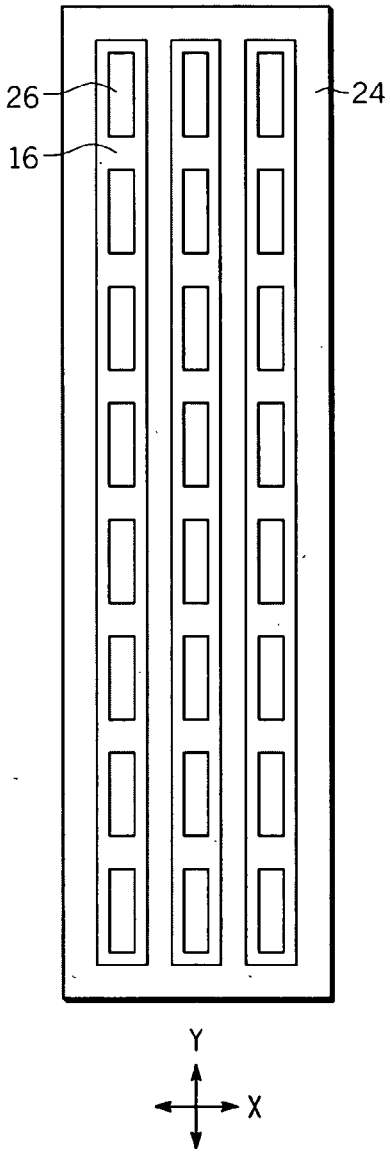
FIG. 3 is a partial schematic view of a subpixel of the device of FIG. 1.

The following detailed description of the invention is merely exemplary in nature and is not intended to limit the invention or the application and uses of the invention. Furthermore, there is no intention to be bound by any theory presented in the preceding background of the invention or the following detailed description of the invention.

Using nanotubes as field emission sources in field emission displays is expected to substantially reduce the manufacturing costs of high voltage displays. A primary cost-saving component is the use of less precise, lower cost lithography than previous field emission display technology. However, the trade-off for this cost savings is that more device real estate is required to define the same number of ballasted emitter pads. Since, the area containing nanotube emitters is larger, there is a comparatively smaller margin between the edge of the nanotube emitter structures and the edges of the phosphor to which their electron beams must be restricted. Consequently, it is more important than ever to substantially reduce the color bleed of the electron beam in order to obtain a good image. The eye is sensitive to cross-talk between colors of less than 3% in static images.

Referring to FIG. 1, a known carbon nanotube field emission device 10 includes a cathode electrode 14 positioned on a substrate 12. A ballast resistive layer 16 is positioned between a dielectric layer 18 and the cathode electrode 14. A catalyst material 20 is positioned on the ballast resistive layer 16 for allowing higher quality growth of carbon nanotubes 22 thereon. A gate electrode 24 is positioned on the dielectric layer 18 for drawing electrons from the carbon nanotubes 22 in a manner known to those skilled in the art.

The catalyst material 20 comprises pads 26 (or pads) of carbon nanotubes 22. In FIG. 1, while three pads 26 are shown, it should be understood that many pads 26 are typically used. Each group of pads 26 is aligned with an area of phosphor 28 of one of three colors, e.g., red, on the anode 30 (FIG. 2). A plurality of pads designated as directing electrons at a given phosphor of one color are referred to as subpixels. As electrons are emitted from the carbon nanotubes 22, the electrical attraction of the gate electrode 24 "pulls" the electrons in the 'x' direction. The closer the gate electrode 24 is to the carbon nanotubes 22, the stronger it pulls the electron beam and, therefore, the more it pulls the electron beam toward neighboring subpixels in the 'x' direction. In addition to the electrons being pulled toward the gate electrode 24, the carbon nanotubes 22 themselves will be pulled, or slant, in the direction of the gate electrode 24. As the carbon nanotubes 22 slant, the electrons are "aimed" in that direction away from the desired phosphor 28, i.e., the 'x' direction. Note also that since there is a smaller gap between phosphors 28 in the 'x' direction than in the 'y' direction, color bleed in the 'x' direction has even more of an impact.

Referring to FIG. 2, the device 10 is shown overlying areas of phosphor 28 on the anode 30. As electrons are pulled by the gate electrode 24 in the 'x' direction, some of the electrons may stray into the adjacent phosphor 28 of a different color. For example, electrons intended for the red phosphor 32 may stray into a green 34 and/or blue 36 phosphor. This color bleed significantly degrades the color image of the field effect device.

The subpixel array of FIG. 3 is one known embodiment that includes three columns of pads 26 positioned on the ballast resistor 16 and surrounded by the gate electrode 24. The three columns of pads 26 paint electrons on a single color providing redundancy in case one pad 26 does not function properly. It is noted that the area of the gate electrode 24 is significantly larger and closer in the 'x' direction from each pad, thereby creating the "pull" in the 'x' direction.

Figure 4:
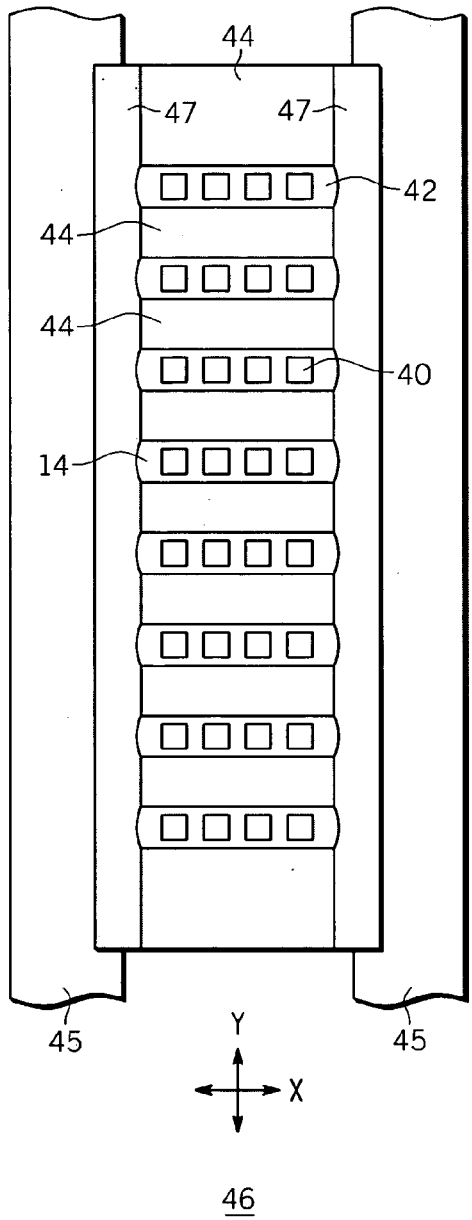
FIG. 4 is a partial schematic view of a subpixel of an array of adjacent emitters arranged in accordance with an embodiment of the present invention.

Referring to FIG. 4, and in accordance with the present invention, pads 40 of carbon nanotubes 22 are positioned in a 4 by 8 configuration on the ballast resistive layer 42 to form the subpixel 46. While a 4 by 8 configuration is illustrated, any sized matrix may be used within the scope of this invention. While the preferred embodiment comprises carbon nanotubes, any cold cathode device that emits electrons, such as metal tips, an emitting film, or any carbon like nanostructure, could be used with the present invention. In this invention, the electric field required to extract electrons from the emitter pads by the gate electrode 44 is applied predominantly from the 'y' direction (there is more of the gate electrode 44 material in the 'y' direction). In this way, the pull from the electrode on the electron beam occurs predominantly in the 'y' direction and any electron drift is thus "encouraged", as defined herein, to drift in the 'y' direction and not the 'x' direction. Additionally, the re-orientiation of emitters (tilting of emitters due to the pull of the field) like carbon nanotubes also occurs predominantly in the y-direction. As a result, the electron beam deflection that results from the extraction electrodes occurs substantially in the 'y' direction toward subpixels 46 of the same color and does not contribute to color mixing by pulling the electrons in the 'x' direction towards subpixels 46 of another color.

In the embodiment in FIG. 4, it is necessary to connect the gate electrode 44 to a common voltage source. This is accomplished by busing the gate electrode 44 together with a gate bus line 47 on the far +x and −x sides of the emitter pads 40. Structurally, the gate bus line 47 is just a part of the gate electrode 44, but functionally it is not spaced to the emitter pads 40 close enough to extract electrons. The gate bus line 47 produces a small deflection field in the 'x' direction, which is not desired. In order to minimize the role of the gate bus lines 47, they must be placed as far as possible from the edges of the emitter pads 40, and they must be as narrow as the design allows. The gate bus line 47 is placed at least twice the distance to the pad in the 'x' direction as the gate electrode 44 is in the 'y' direction. Preferably this distance would be a multiple of four. At twice the distance, it is assured that the electric field due to the gate bus line 47 is at least half the value in the 'x' direction as in the 'y' direction. In terms of the physics of the device, this means in general that the field in the 'x' direction from the gate bus line 47 is insufficient to induce field emission at the pads 40 at the operating voltage of the gate electrode 44, if the gate electrode 44 in the 'y' direction were absent. The gate bus line 47 is not acting as an extraction electrode. The pull of the electron beam by the gate bus line 47 is further minimized by making the bar as thin as design rules for conductor lines allow so that the electron beam encounters its potential for only a short period of time.

Optionally, column electrode lines 45, which is coupled to the pads 40, may be positioned at the sides of the subpixel 46. Since the potential of the pads 40 is from 0 to approximately 15 volts above the cathode electrode line 45, column electrode lines 45 provides some co-planar focusing in the x-direction (towards the pads 40 and away from the column electrode lines 45 and the neighboring phosphor of another color).

Referring to FIG. 5, the column electrode line 52 can be used to shield the field from the gate bus line 47. By running an exposed section of this electrode between the pads 40 and the gate bus line 47, a stronger co-planar focusing effect can be realized from the column electrode line 52. Also, the ballast resistor in the region between the end pad and the gate bus line 47 is at a potential lower than the gate electrode 44, and thereby partially shields the field from the gate bus bar.

Referring to FIG. 6, another embodiment has the gate bus line 47 running through the middle of the pad area and no gate electrode 44 in the 'x' direction from the pads 40, thereby providing absolutely no pull of the electron beam (or emitters in the case of carbon nanotube emitters) in the x-direction. In this case, the end pads 40 are closer to the neighboring pixel 46 in the x-direction, but there is no gate bus line 47 in the region at the far sides of the row of pad 40. Consequently, there is no field contribution from the gate electrode 44 near the edges of the subpixel 48. Preferably, the gate bus line 47 down the middle would also be twice the distance from the nearest pads than the distance from the gatel electrode 44 along the rows. However, if the gate electrode 44 is closer and provides a significant pulling field, or even a field large enough to induce electron emission, the affect on color purity is minimal because the affected beams are in the middle of the subpixel 48.

In the embodiments where a pixel is square, each color subpixel will be rectangular and the long direction will be in the 'y' direction. In this configuration it is highly desirable to apply the present invention. With the gate electrodes pulling in the 'y' direction in preference to the 'x' direction, the electron beam from each pad is pulled more along 'y'. Because 'y' is a much longer direction than x, the percentage of the beams that impinge on the proper phosphor area is larger than it would be if the pixel were comparatively shorter in the 'y' direction. In summary, this embodiment allows the composite electron beam for each subpixel to better match the corresponding phosphor area, thereby reduced bleed over and electrons which strike the black surround areas of the anode. This improves the device efficiency and brightness.

In addition, anode designs which leave room for a spacer between pixels in the y-direction have a larger gap between pixels in the y-direction than in the x-direction. This larger gap in the 'y' direction makes the phosphor in the 'y' direction less sensitive to electron bleedover from the adjacent subpixel (in y). If there are any electrons reaching the pixel in the 'y' direction, there will be no color error. In fact, the uniformity of the image may be enhanced.

Referring to FIG. 7, subpixels 46 are positioned in alignment with phosphor region 28 on anode 30. Since any "color bleed", or pull of electrons, is in the 'y' direction, any straying electrons will move into the adjacent phosphor in the 'y' direction of the same color instead of moving in the 'x' direction into a phosphor of a different color. This encouragement of any drifting electrons towards adjacent phosphors of the same color instead of adjacent phosphors of a different color significantly reduces color bleed and improves the color gamut. It should be understood that the phosphor regions 28 in the preferred embodiment are red 32, green 34, and blue 36, they may comprise other colors as well.

Figure 8:
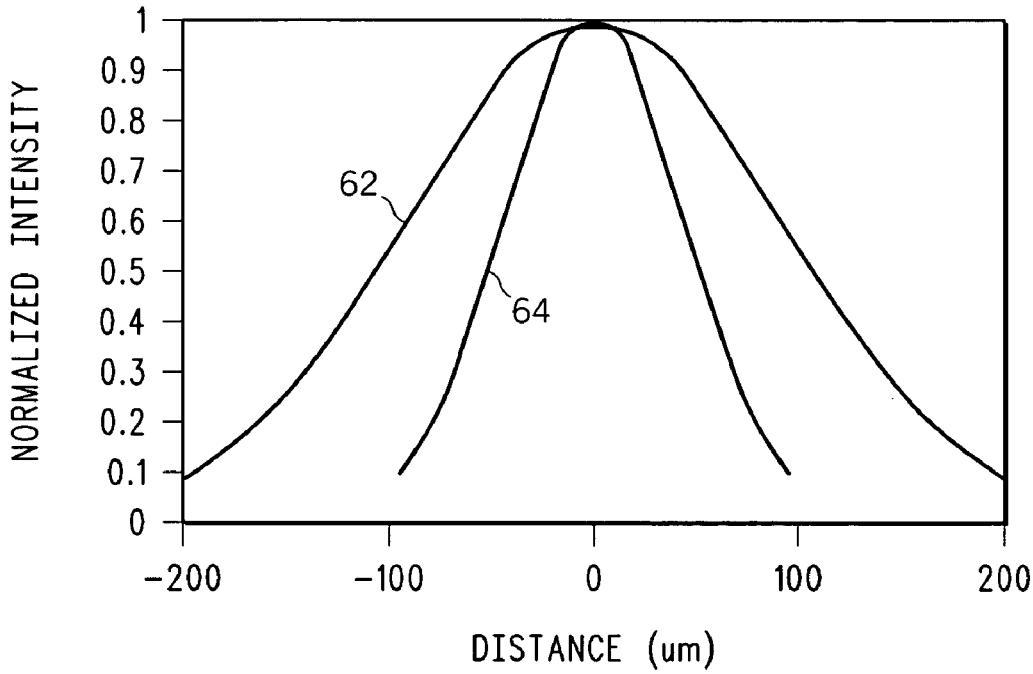
FIG. 8 is a graph of distance versus normalized intensity for the embodiment of FIG. 4 and the known device of FIG. 3.

Referring to FIG. 8, the electron drift 62 of the known device of FIG. 3 and the electron drift 64 of the device of the present invention of FIG. 4 are plotted as distance versus normalized intensity. It may be seen that the present invention provides a substantially more focused beam in the x-direction for a given anode distance. The present invention reduces the beam width by nearly a factor of two without reducing the area in which the pads reside. Since the intrinisic beam size from the pads can be substantially reduced, the present invention allows for higher resolution geometries. Additionally, more pads can be disposed in the subpixel area without causing bleed over, thereby improving the brightness and short range subpixel to subpixel uniformity of the display. The short range uniformity is improved because the increase in the number of pads provides additional statistical averaging. When more pads are accommodated in the emitting area, the device designer can also choose to maintain the same brightness level. In this case the extraction voltage to achieve a given brightness is reduced. This, in turn, reduces the beam size in the 'y'-direction.

Figure 9:
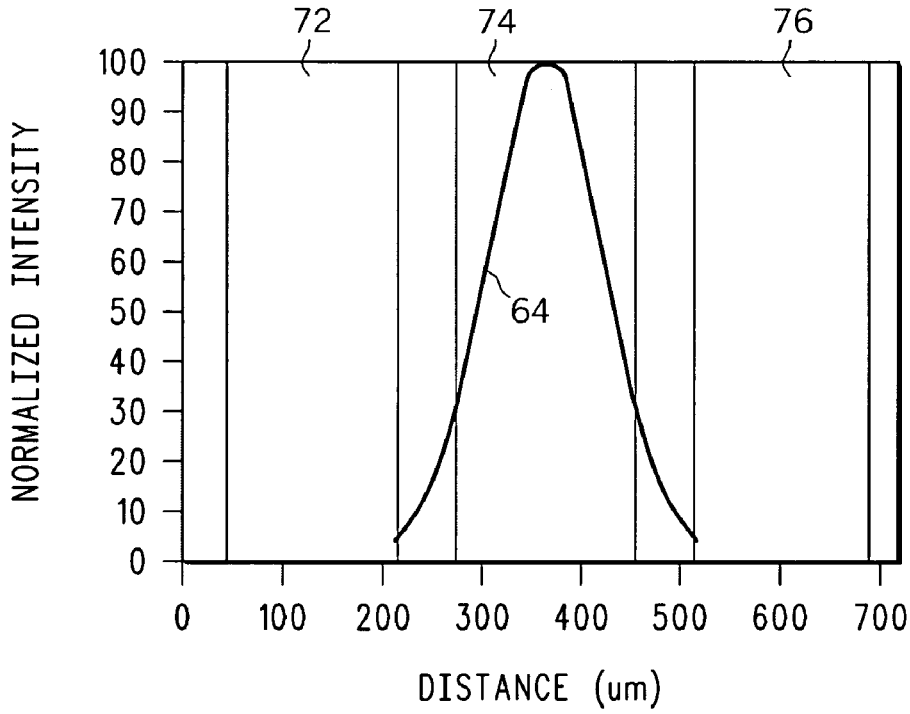
FIG. 9 is a graph comparing electron drift versus normalized intensity for the embodiment of FIG. 4.

Referring to FIG. 9, electron drift 64 of the device of the present invention is plotted as distance versus normalized intensity against a background with areas 32, 34, and 36 representing red, green, and blue, respectively. This electron beam profile measured from one of the devices, built with the design depicted in FIG. 4, uses a 726 micrometer square subpixel, the size used for a 42" diagonal 1280x 720 HDTV display. It can be seen that there is minimal electron drift from green to the neighboring colors of red and blue in the x-direction, so the application of this invention is sufficient to provide the required color purity.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. A display device comprising:

an anode having a surface;

first and second phosphors of an identical color positioned adjacent to one another on the anode in a first direction along the surface; and a cathode comprising:

a cathode electrode;

a plurality of pads of emitter structures formed on the cathode electrode, wherein the first phosphors are positioned to receive electrons from the emitter structures; and a gate electrode positioned adjacent to and spaced apart from the emitter structures so any electron drift is encouraged toward the second phosphor.

2. The display device of claim 1 wherein the emitter structures are carbon nanotubes.

3. The display device of claim 1 wherein any tilting of the emitter structures is encouraged to be towards the other phosphor from which it is intended.

4. The display device of claim 1 further comprising a column electrode line positioned along the side of each of the groups of emitter structures for carrying a potential no greater than that that carried by the emitter structures.

5. A display device comprising:

an anode;

a plurality of phosphors of at least first and second colors, each phosphor disposed on the anode so that each phosphor has an adjacent phosphor of the same color and an adjacent phosphor of the other color;

a cathode arranged in parallel opposed position to and separated from the anode; and a plurality of pads having a plurality of emitters, each pad disposed on the cathode in spaced relationship to and aligned with one of the first and second colors, respectively; and a gate electrode having an electron extraction field applied to each pad which is at least twice the magnitude in the direction of an adjacent phosphor of the same color than toward an adjacent phosphor of a different color.

6. The display device of claim 5 wherein the emitters are carbon nanotubes.

7. The display device of claim 5 wherein any tilting of the emitters is encouraged to be towards a phosphor of the same color as the phosphor to which it is aligned.

8. The display device of claim 5 wherein the distance between phosphors of the same color is less than the distance between phosphors of another color.

9. The display device of claim 5 wherein the distance between phosphors of the same color is less than half the distance between phosphors of another color.

10. The display device of claim 5 wherein the gate electrode is spaced apart from the pads at least twice the distance in the direction of phosphors of another color than towards phosphors of the same color.

11. The display device of claim 5 wherein the gate electrode is spaced apart from the pads at least four times the distance in the direction of phosphors of another color than toward phosphors of the same color.

12. The display device of claim 5 wherein the pads are arranged in subpixels, the display device further comprising a column electrode line positioned along the side of each of the subpixels in the direction of adjacent phosphors of the other color for carrying a potential less that that carried by the emitter structures.

13. A display device comprising:

an anode having a surface;

a first pixel comprising phosphor regions of first, second, and third colors sequentially disposed on the anode in a first direction along the surface;

a second pixel comprising phosphor regions of the same first, second, and third colors sequentially disposed on the anode in the first direction, and positioned so the first, second, and third phosphor regions of the second pixel are adjacent, in a second direction along the surface, the first, second, and third phosphors, respectfully, of the first pixel;

a cathode comprising:

a cathode electrode; and a plurality of groups of emitter structures formed on the cathode electrode, wherein the first, second, and third phosphors of the first and second pixels are each aligned to receive electrons from a designated group of emitter structures; and a gate electrode that applies an electron extraction field applied to the emitter structures which is at least twice the magnitude in the second direction than in the first direction, wherein any electron beam divergence is encouraged to be in the second direction instead of the first direction.

14. The display device of claim 13 wherein the emitter structures are carbon nanotubes.

15. The display device of claim 13 wherein any tilting of the emitter structures is encouraged to be in the second direction instead of the first direction.

16. The display device of claim 13 wherein the distance between phosphor subpixels in the first direction is less than the distance between phosphor subpixels in the second direction.

17. The display device of claim 13 wherein the distance between phosphor subpixels in the first direction is less than half the distance between phosphor subpixels in the second direction.

18. The display device of claim 13 wherein the gate electrode is spaced apart from the emitter structures at least twice the distance in the second direction as in the first direction.

19. The display device of claim 13 wherein the gate electrode is spaced apart from the emitter structures at least four times the distance in the second direction as in the first direction.

20. The display device of claim 13 further comprising a column electrode line positioned along the side of each of the groups of emitter structures in the first direction for carrying a potential less that that carried by the emitter structures.

* * * * *